US009970272B2

(12) United States Patent
Semple et al.

(10) Patent No.: US 9,970,272 B2
(45) Date of Patent: May 15, 2018

(54) OIL PRESSURE REGULATOR FOR ELECTRICAL SUBMERSIBLE PUMP MOTOR

(71) Applicant: Baker Hughes Incorporated, Houston, TX (US)

(72) Inventors: Ryan P. Semple, Owasso, OK (US); Aron M. Meyer, Pryor, OK (US); David Tanner, Broken Arrow, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 444 days.

(21) Appl. No.: 14/667,093

(22) Filed: Mar. 24, 2015

(65) Prior Publication Data

US 2015/0354327 A1 Dec. 10, 2015

Related U.S. Application Data

(60) Provisional application No. 62/008,813, filed on Jun. 6, 2014.

(51) Int. Cl.

| | |
|---|---|
| ***F04D 13/10*** | (2006.01) |
| ***E21B 43/12*** | (2006.01) |
| ***F04D 29/08*** | (2006.01) |
| ***F04D 13/06*** | (2006.01) |

(52) U.S. Cl.

CPC ..... *E21B 43/128* (2013.01); *F04D 13/062* (2013.01); *F04D 13/10* (2013.01); *F04D 29/086* (2013.01)

(58) Field of Classification Search

CPC .. E21B 43/128; E21B 43/129; E21B 41/0007; E21B 4/00; E21B 4/003; E21B 4/16; E21B 4/04; E21B 4/12; F04D 13/10; F04D 13/086; F04D 13/008; F04D 29/086; F04D 29/106; F04C 15/0034

USPC ..... 417/414, 423.4, 423.11, 52; 166/105; 73/152.59

See application file for complete search history.

(56) References Cited

U.S. PATENT DOCUMENTS

| | | | | |
|---|---|---|---|---|
| 1,842,457 | A * | 1/1932 | Mendenhall | F04B 47/06 175/104 |
| 3,154,018 | A * | 10/1964 | Willits | F04B 47/04 137/494 |
| 3,947,709 | A * | 3/1976 | Waltman | H02K 5/132 310/87 |
| 7,520,735 | B2 | 4/2009 | Merrill et al. | |
| 7,530,391 | B2 | 5/2009 | Hall et al. | |
| 7,665,975 | B2 | 2/2010 | Parmeter et al. | |

(Continued)

*Primary Examiner* — Patrick Hamo

(74) *Attorney, Agent, or Firm* — Bracewell LLP; James E. Bradley

(57) ABSTRACT

An electrical submersible pump assembly has a pump driven by a motor. A pressure compensator has first and second bellows units axially separated from each other. Each of the first and second bellows units are movable between an increased volume position and a decreased volume position and have a bias toward the decreased volume position. The bias of the first bellows unit is greater than the bias of the second bellows unit. The greater bias of the first bellows unit over the second bellows unit causes the second bellows unit to be at a full volume position at a lower level of the pressure differential than the level at which the first bellows unit is at the full volume position.

16 Claims, 5 Drawing Sheets

(56) References Cited

U.S. PATENT DOCUMENTS

| | | | | |
|---|---|---|---|---|
| 7,708,534 | B2 | 5/2010 | Parmeter et al. | |
| 7,741,744 | B2 * | 6/2010 | Watson | E21B 43/128 166/108 |
| 8,221,092 | B2 | 7/2012 | Chilcoat et al. | |
| 8,485,797 | B2 * | 7/2013 | Martinez | E21B 43/128 310/87 |
| 8,651,837 | B2 * | 2/2014 | Tetzlaff | F04B 47/06 310/87 |
| 2004/0146415 | A1 * | 7/2004 | Merrill | F04D 13/083 417/414 |
| 2007/0074872 | A1 * | 4/2007 | Du | E21B 4/003 166/369 |
| 2014/0202681 | A1 | 7/2014 | Merrill et al. | |
| 2015/0322770 | A1 * | 11/2015 | Meyer | E21B 47/0007 417/413.1 |

* cited by examiner

OIL PRESSURE REGULATOR FOR ELECTRICAL SUBMERSIBLE PUMP MOTOR

CROSS REFERENCE TO RELATED APPLICATION

This application claims priority to provisional application 62/008,813, filed Jun. 6, 2014.

FIELD OF THE INVENTION

This disclosure relates in general to submersible well pomp assemblies and in particular to a mechanism that controls the internal lubricant pressure within the motor.

BACKGROUND

Electrical submersible pumps (ESP) are commonly used in hydrocarbon producing wells. A typical ESP includes a pump operatively coupled to a motor that is filled with a lubricant. A pressure compensator, equalizer, or seal section has a movable element that equalizes the lubricant pressure with the hydrostatic pressure of the well fluid.

The pressure compensator may have one or more bags or bellows, which are typically metal, located within a housing. Normally, the pressure compensator locates between the motor and the pump. A shaft from the motor extends through the bags or bellows. A shaft seal located at the upper end of the compensator seals against the entry of well fluid into the compensator. The typical shaft seal comprises a metal face seal that has a rotating face urged against a stationary face. Some leakage of lubricant from the compensator past the seal is desired to lubricate the faces. During filling with lubricant, the hags or bellows will be expanded when filled. A bias of the bag or bellows toward a contracted position provides a positive pressure differential of the lubricant over the hydrostatic pressure of the well fluid. The positive pressure differential assures dial lubricant may leak out, but restricts the entry of well fluid. Over time, the bias force of the bag or bellows decreases as the lubricant is depleted, lowering the positive pressure differential. Maintaining a positive pressure differential may increase the life of the ESP.

SUMMARY

An electrical submersible pump assembly includes a pump and a motor operatively coupled to the pump. The assembly has first and second compensating elements, each having one side adapted to be in fluid communication with hydrostatic fluid pressure and another side in fund communication with motor lubricant pressure of motor lubricant contained in a lubricant chamber. The first and second compensating elements axe movable in response to a pressure differential between hydrostatic well field pressure and motor lubricant pressure. The first compensating element is configured to be movable in response to the pressure differential being above a selected level and below the selected level. The second compensating element is configured to be movable only in response to the pressure differential being below the selected level.

In the preferred embodiments each of the first and second compensating elements comprises a bellows. The bellows of the second compensating element has a lesser spring rate to move toward an extended position than the bellows of the first compensating element. The bellows of the first and second compensating elements are arranged such that when the bellows of the first compensating element contracts in response to a change in the pressure differential while below the selected level, the bellows of the second compensating element also contracts.

Each of the bellows has an extended position and a contracted position, and each is biased toward the contracted position. The bellows of the first compensating element requires a greater force to move to the extended position than the bellows of the second compensating element.

The bias of the bellows of the first compensating element causes the bellows to be between the contracted position and the extended position while at the selected level of the pressure differential. The bias of the bellows of the second compensating element causes the bellows to be at the extended position while at the selected level of the pressure differential.

The bias of the bellows of the first compensating element causes the bellows to be at the extended position at a level above the selected level of the pressure differential. The bias of the bellows of the second compensating element causes the bellows to be at the extended position at the selected level of the pressure differential. The bellows of the second compensating element is configured to be at the contracted position while at a lower level of the pressure differential below the selected level. The bellows of the first compensating element is configured to be between the contracted and the extended positions when the pressure differential is below the lower level.

In the preferred embodiment, a housing contains the first and the second compensating elements. First second and third bulkheads are axially spaced apart and fixed in the housing. The first compensating element extends from the first to the second bulkhead. The second compensating element extends from the second to the third bulkhead. A lubricant passage in the second bulkhead communicates lubricant in an interior of the first compensating element directly with lubricant in an inferior of the second compensating element.

Preferably, each of the first and second compensating elements comprises a bellows with an interior containing the motor lubricant and an exterior adapted to be immersed in the well fluid. The bellows of the first and second compensating elements are arranged such that when the bellows of the first compensating element contracts in response to a change in the pressure differential while below the selected level the bellows of the second compensating element also contracts.

The bellows of the first compensating element may have a greater volume and greater spring rate than the bellows of the second compensating element. Optionally, one of the compensating elements may be located above the motor and the other below the motor.

BRIEF DESCRIPTIONS OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
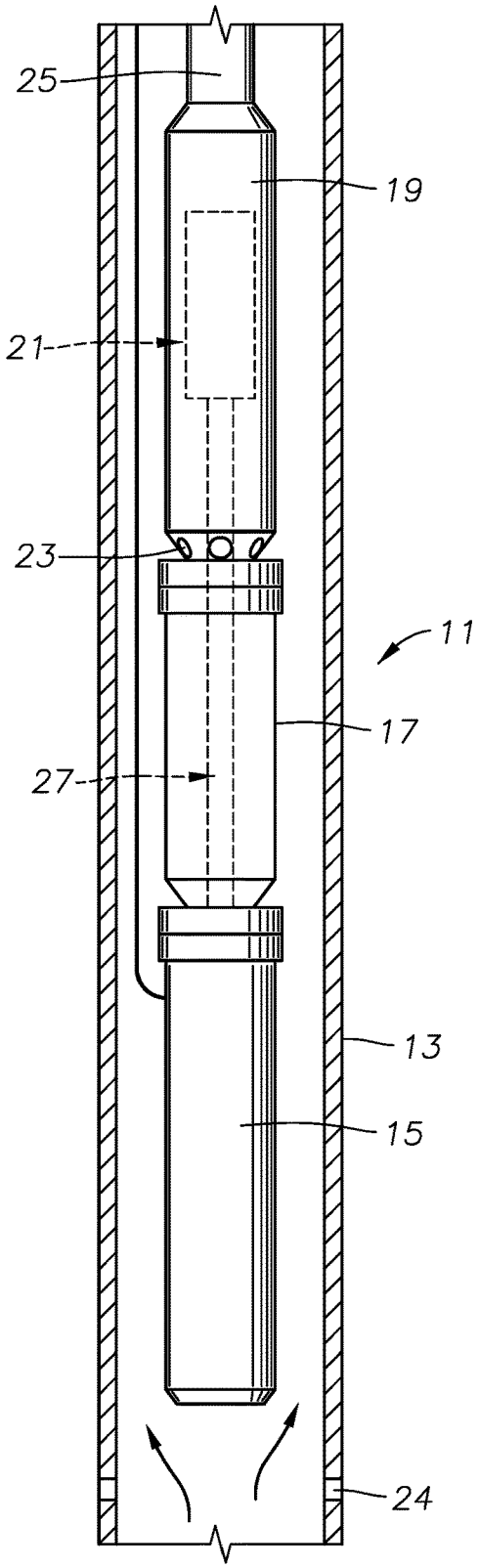
FIG. 1 is a side view of an electrical submersible pump assembly in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 5:
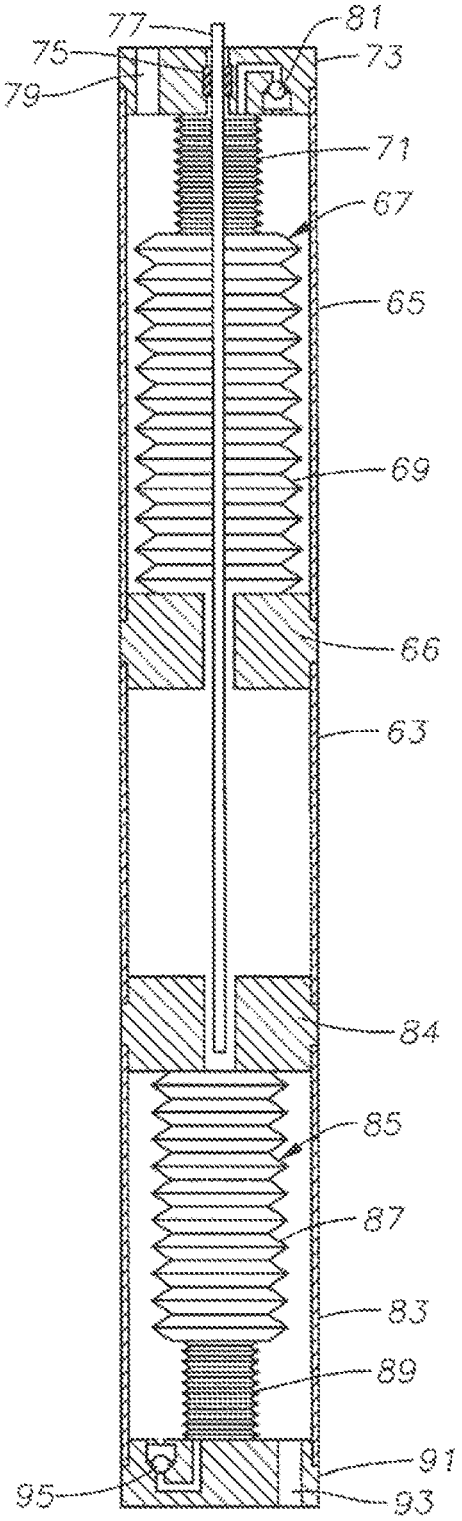
FIG. 5 is a schematic view of an alternate embodiment of the pressure compensation system of FIG. 2.

FIG. 1 shows an electrical submersible pump (ESP) 11 suspended in a cased well 13. ESP 11 typically includes an electrical motor 15. Motor 15 is normally a three-phase AC motor with a stator and rotor and may be connected in tandem to other motors. A seal section or pressure compensator 1 is illustrated at an upper end of motor 15. Alternately, pressure compensator 17, or at least part of it, could be mounted below motor 15, as illustrated in FIG. 5. Although shown vertically suspended, ESP 11 may be installed within inclined or horizontal portions of a well. Also, the positions of the various components can change. Thus the terms "upper" and "lower" are used only for convenience and not in a limiting manner.

A pump 19 connects to the upper end of pressure compensator 17 in this example. Pump 19 could be a centrifugal pomp with a large number of stages 21, each stage having an impeller and a diffuses. Alternately, pump 19 could be another type, such as a progressing cavity pump. Pump 19 has an intake 23 for admitting well fluid from casing perforations 24 or other openings. A gas separator (not shown) could be mounted below pump 19, and if so, intake 23 would be in the gas separator. A string of production tubing 25 secures to the upper end of pump 19 and supports ESP 11 in well 13. Production tubing string 25 may comprise sections of tubing with threaded ends secured together, or it could be continuous coiled tubing. In this illustration, pump 19 discharges through tubing 25 to a wellhead (not shown) at the upper end of well 13. A shaft 27 extends from within motor 15 through pressure compensator 17 and pump 19 for driving pump 19. Shaft 27 normally comprises separate shafts within motor 15, pressure compensator 17 and pump 19 coupled together with splined couplings.

Figure 2:
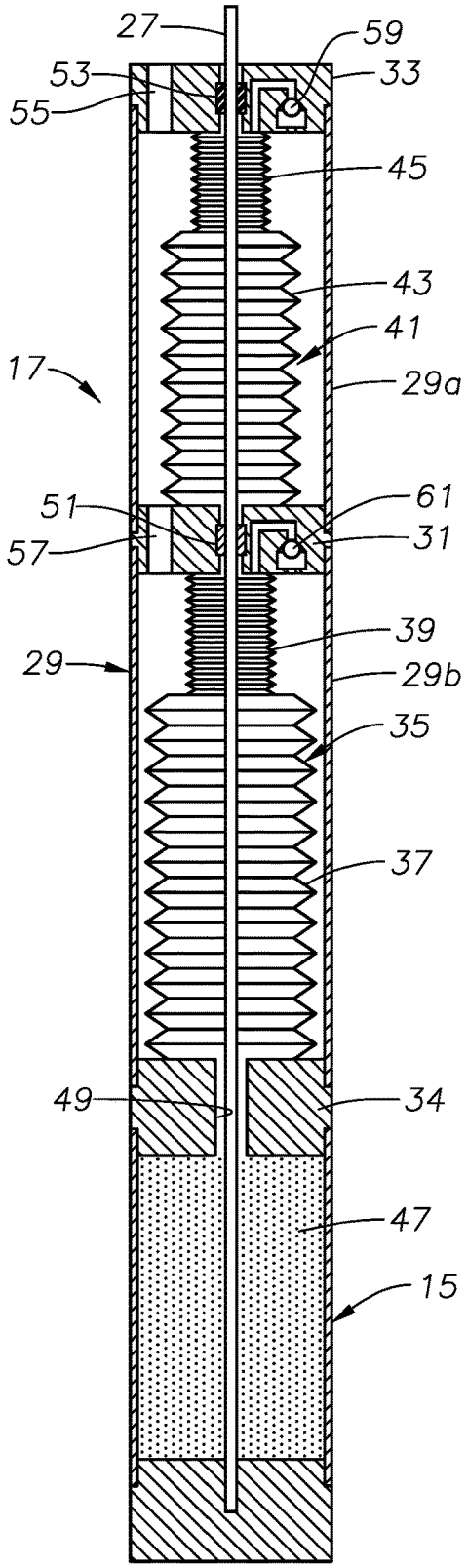
FIG. 2 is a schematic sectional view of a pressure compensation system that controls the internal lubricant pressure within the motor of the assembly of FIG. 1.

Referring to FIG. 2, pressure compensator 17 has a tubular housing 29 that in this embodiment has an upper housing section 29*a* and a lower housing section 29*b*. A threaded central connector or bulkhead 31 secures the lower end of upper housing section 29*a* to the upper end of lower housing section 29*b*. A threaded upper connector or bulkhead 33 secures to the upper end of upper housing section 29*a* for connecting to the intake 23 (FIG. 1), normally by bolting. A lower connector or bulkhead 34 at the lower end of lower housing section 29*b* connects to motor 15, normally with bolts. Alternately, upper and lower connectors 33, 34 could employ rotatable threaded collars instead of bolts.

In this embodiment, lower housing section 29*b* contains a main compensator 35. Preferably main compensator 35 comprises a bellows unit that includes a larger diameter tubular bellows, referred to herein as the outer bellows 37, and a smaller diameter tubular bellows. referred to herein as an inner bellows 39. In practice a lower portion of inner bellows 39 extends into the interior of outer bellows 37. The upper end of outer bellows 37 and the lower end of inner bellows 39 are sealed to each other. The upper end of inner bellows 39 seals to central connector 31, and the lower end of outer bellows 37 seals to lower connector 34. The interiors of outer bellows 37 and inner bellows 39 are in fluid communication with each other. The side walls of outer bellows 37 and inner bellows 39 are corrugated and will flex between extended and contracted positions.

Housing upper section 29*a* contains a second compensator, referred to herein as a regulator compensator 41. In this embodiment, regulator compensator 41 comprises a bellows unit with a tubular, metal outer bellows 43 and a tubular, metal inner bellows 45. Although not shown, a lower portion of inner bellows 45 preferably extends into the interior of outer bellows 43. The upper end of outer bellows 43 and the lower end of inner bellows 45 are sealed to each other. The upper end of inner bellows 45 seals to upper connector 33, and fee lower end of outer bellows 43 seals to central connector 31. The interiors of outer bellows 43 and inner bellows 45 are in fluid communication with each other. The side walls of outer bellows 43 and inner bellows 45 are corrugated and will flex between extended and contracted positions.

The interiors of main compensator 35 and regulator compensator 41 are in fluid communication with motor lubricant 47 that fills motor 15. In this example, a shaft annulus passage 49 surrounding shaft 27 in lower connector 34 allows the flow of lubricant 47 between motor 15 and the interior of main compensator 35. A bushing 51 radially stabilizes shaft within central guide 51, but does not seal in this example. Motor lubricant 47 within main compensator 35 communicates directly with motor lubricant 47 in regulator compensator 41 through the passage containing bushing 51 in central connector 31.

A shaft seal 53 seals shaft 27 within upper connector 33. Shaft seal 53 seals well fluid from entry into the interior of regulator compensator 41. Typically, shaft seal 53 is a mechanical face seal having a rotating face urged against a stationary face by a spring enclosed within a rubber boot. A well fluid entry port 55 in upper connector 33 admits well fluid into upper housing section 29*a* into contact with the exterior of regulator compensator 41. A well fluid communication port 57 extends through central connector 31 from the upper to the lower side of central connector 31, admitting well fluid into lower housing section 29*b*. The well fluid in lower housing section 29*b* will be in contact with the exterior of main compensator 35.

An optional passage having a check valve 59 in tipper connector 33 extends from the interior of regulator compensator 41 to the exterior of regulator compensator 41 within upper housing section 29*a*. Check valve 59 will allow lubricant 47 within regulator compensator 41 to expel into the well fluid in upper housing section 29*a* if the internal motor lubricant pressure in regulator compensator 41 exceeds the pressure of the well fluid on the exterior of regulator compensator 41 by a selected amount. Similarly, an optional passage having a check valve 61 in central connector 31 extends from the interior of main compensator 35 to the exterior within lower housing section 29*b*. Check valve 61 will allow lubricant 47 within main compensator 33 to expel into the well fluid in lower housing section 29*b* if the internal motor lubricant pressure in main compensator 35 exceeds the pressure of the well fluid on the exterior of main compensator 35 by a selected amount. The fluid pressure of lubricant 4 within regulator compensator 41 should always be the same as the fluid pressure of lubricant 47 within main compensator 35 because both are in free communication with lubricant 47 in motor 15.

In this embodiment, main outer bellows 37 and main inner bellows 39 will extend and contract from a neutral position. While main outer bellows 37 is being extended, main inner bellows 39 contracts. Main enter bellows 37 and main inner bellows 39 each have their own spring rate or stiffness that must be overcome to move from the neutral position to a contracted position and an extended position. As main outer bellows 37 and main inner bellows 39 are combined, the combined main compensator 35 will have it's own neutral position and the combined spring rate will be the sum of the spring rates of the individual bellows 37, 39. A significant force is required to move main compensator 35 from it's neutral position, either in extension or compression. Normally, the force required to extend or contract main inner bellows 39 would be significantly less because of the smaller diameter and possibly thinner walls than outer bellows 37.

When lubricant 47 is pumped from a motor fill port into main outer bell uses 37 during initial filling before deploying ESP 11, the pumping pressure will be sufficient to overcome that stillness and move main outer bellows 37 to an extended full volume position, which could be fully extended. The natural bias of main outer bellows 37 is to contract from the extended position, but once the fill and expel ports for the chamber for lubricant 47 are closed, that natural bias will not be able to cause main outer bellows 37 to start contracting. The bias of main outer bellows 37 thus applies a positive pressure to the lubricant 47 trapped within the chambers of motor 15 and compensator 17. When positive, the pressure of lubricant 47 trapped within the chambers of motor 15 and main compensator 35 is greater than pressure on the exterior of main compensator 35. During filling, if main compensator 35 is completely filled and extended to its maximum length, the positive internal pressure can still be increased more due to the action of the pump being used to fill motor 15 and compensator 17.

Similarly, in this embodiment regulator compensator 41 requires a force to move regulator outer bellows 43 from a contracted position to an extended position. The bias of regulator outer bellows 43 is also to contract thus adding to the positive pressure of motor lubricant 47 upon completion of filling. The overall spring rate or stiffness of regulator compensator 41 is less than the spring rate or stiffness of main compensator 35. When fully extended, the volume of motor lubricant 47 contained within regulator compensator 41 may be greater, equal or less than the maximum volume of main compensator 35. The axial distance or height of regulator compensator 41 could be more or less than main compensator 35.

In this embodiment, the spring rate of regulator compensator 41 is selected so that during filling, regulator outer bellows 43 reaches a fully extended position before main outer bellows 37 reaches a fall volume position, which may be fully extended. For example, when the internal pressure of lubricant 47 in main outer bellows 37 and regulator outer bellows 43 during filling reaches 30 psi, fee force exerted by that pressure will have moved regulator outer bellows 43 to its folly extended position, but not main outer bellows 37 because of its greater resistance to being moved to the fully extended position. Continued pumping of lubricant 47 into motor 15 and compensator 17 increases the pressure and eventually would move main outer bellows 37 to its fully extended position. As an example, the lubricant 47 pressure may be at 50 psi once main outer bellows 37 reaches a desired extended position, which could be fully extended.

Also, preferably, regulator outer bellows 43 has a spring rate and dimension that causes it to reach a fully contracted position before main outer bellows 37 becomes fully contracted. As explained below, the volume of lubricant 47 depletes during long term operation of ESP 11, which causes main outer bellows 37 and regulator outer bellows 43 to contract. As main outer bellows 37 and regulator outer bellows 43 contract the positive internal lubricant pressure decreases because the bias forces that urge the bellows 37, 43 to contract decline as the bellows approach their fully contracted positions. Because of the greater bias force of main outer bellows 37 over regulator enter bellows 43, it will still have a resilient force acting on it and pushing ii toward the contracted position after regulator outer bellows 43 is fully contracted. For example, regulator outer bellows 43 may be sized so that it reaches a fully contracted position when there is still 30 psi of lubricant 47 pressure due to the continuing bias of outer bellows 43. The lubricant pressure differential would be zero when main outer bellows 37 reaches its fully contracted or depleted position.

Prior to lowering ESP 11 into the well, a differential fluid pressure will thus exist at the main shaft seal 53 based on both the bias of both main compensator 35 and regulator compensator 41. That is, the inner fluid pressure within compensators 35, 41 and motor 15 less the external pressure surrounding motor 15 will be the differential fluid pressure. As ESP 11 is lowered into the well, well fluid enters housing sections 29*a*, 29*b*, and the hydrostatic well fluid pressure begins to act on both the main compensator 35 and regulator compensator 41. Compensators 35, 41 allow the fluid pressure of lubricant 47 to equalize with the well fluid hydrostatic pressure. Due to the bias of compensator 35, 41, a differential of lubricant pressure in excess of hydrostatic pressure would still remain as ESP 11 is being deployed.

The differential fluid press are at main shaft seal 53 is resisted by the spring-biased contacting faces of main shaft seal 53. Regardless of the differential fluid pressure, some leakage of lubricant 47 past the faces of main shaft seal 53 occurs. Manufacturers of shaft seals of this type recommend some leakage of lubricant to lubricate the faces of the shall seal during operation. ESPs are designed to operate within a well without servicing for a long period of time, typically years. If the leakage of lubricant past the shaft seal is too high, the volume of lubricant in the motor and compensator depletes too quickly. If too low, the faces of the shaft seal wear too quickly. Normally, the greater the differential pressure, the greater the leakage rate.

Other factors affect the pressure differential of internal lubricant 47 over the well fluid hydrostatic pressure. Well temperature and heat generated by motor 15 while running increase the temperature of lubricant 47, causing it to expand. If the total chamber volume containing lubricant 47 is not able to expand because both bellows 37, 43 are fully extended, the differential pressure can increase, at least up to the point where check valves 59, 61, if employed, expel some of the lubricant 47. If main bellows 37 wasn't completely extended or full upon initial filling, it could further extend while in the well to accommodate additional volume due to thermal expansion.

Also, cooling of lubricant 47 can affect the lubricant pressure. ESP 11 will be shut down and later restarted from time to time for various operational reasons. Normally, lubricant 47 would cool, which decreases the volume of lubricant. Also, an operator may inject a well treating fluid into the wed while the pump is located in the well. The well treating fluid may cool lubricant 47, which decreases the volume of lubricant. When back to a normal operating temperature, lubricant 47 would expand back to the previous volume. The extension and contraction of main outer bellows 37 accommodates the thermal expansion and contraction of lubricant volume to maintain a generally constant positive lubricant pressure differential on main shaft seal 53.

Figure 3:
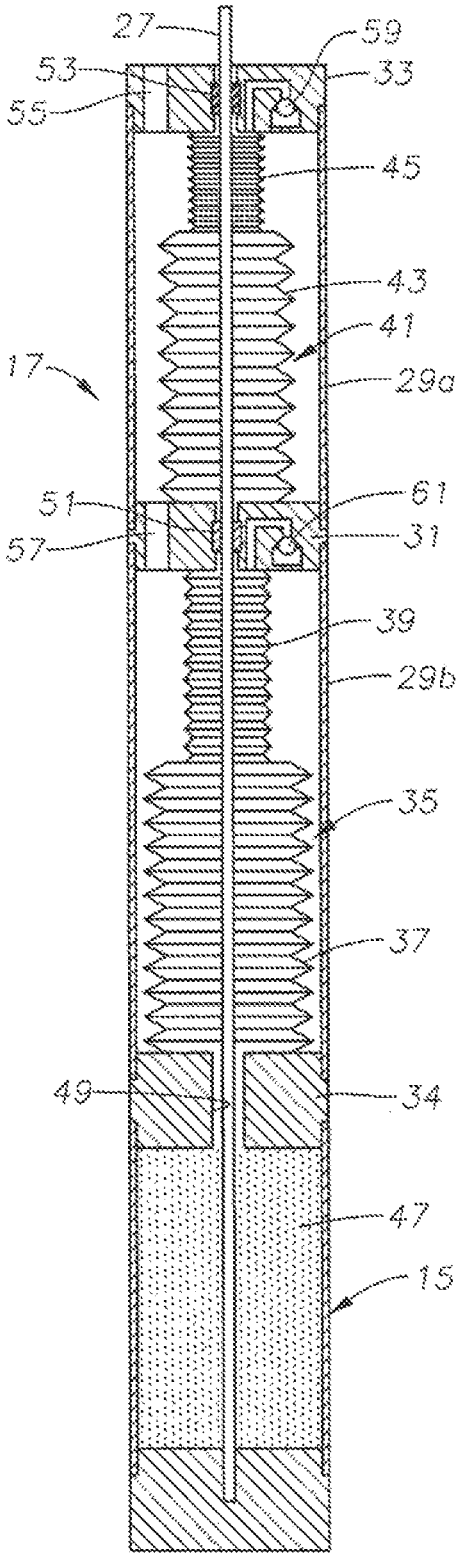
FIG. 3 is a schematic view of the pressure compensation system of FIG. 2, but showing the main outer bellows partly contracted.

While motor 15 is running, main outer bellows 37 also gradually contracts as the volume of lubricant in the system gradually decreases due to leakage past main shaft seal 53. The contraction of main outer bellows 37 decreases the differential pressure of lubricant 47 at main shaft seal 53 because as it contracts, its bias force decreases. For example, a selected increment of volume contraction of main outer bellows 37 causes a decrease in 5 psi of lubricant pressure differential. In the preferred embodiment, initially, regulator outer bellows 43 remains fully extended while main outer bellows 37 contracts. FIG. 3 illustrates a schematic position of main outer bellows 37 partly contracted while regulator outer bellows 43 is still fully extended. The reason that regulator outer bellows 43 has not began to contract is that the differential pressure at main shaft seal 53 is still high enough due to the bias of main outer bellows 37 to overcome the bias of regulator outer bellows 43 urging it to contract. For example, main outer bellows 37 may be able to begin contracting when the pressure differential at main shaft seal 53 is 50 psi; and regulator outer bellows 43 may not be able to begin contracting until the pressure differential drops to 30 psi.

Figure 4:
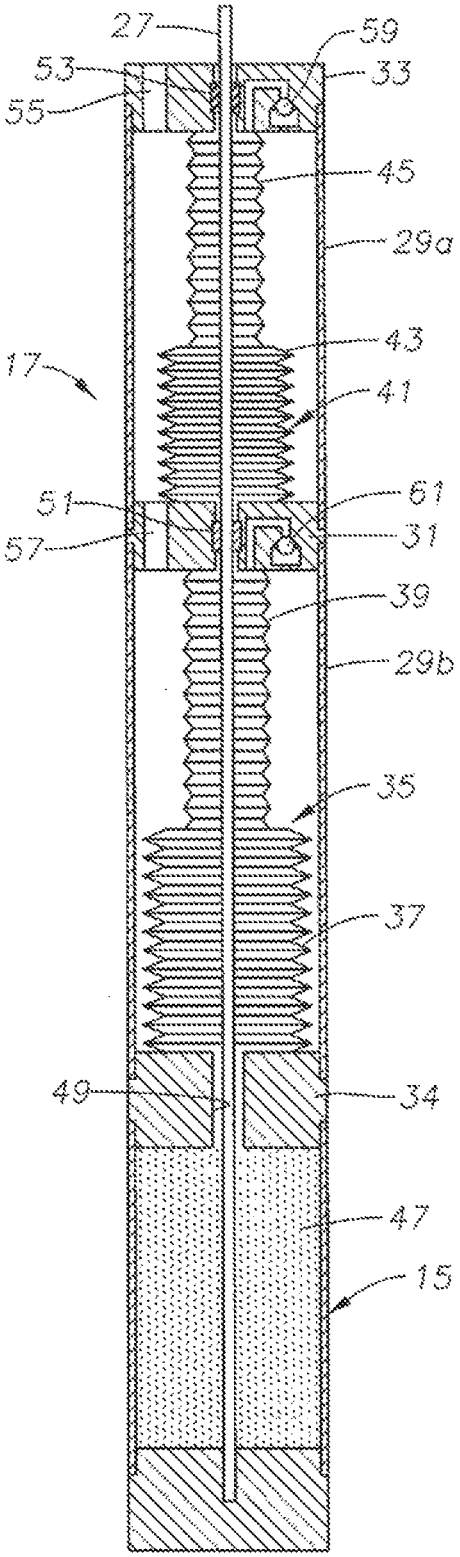
FIG. 4 is a schematic view of the pressure compensation system of FIG. 2, but showing both the main and the regulator main bellows partly contracted.

When main outer bellows 43 has contracted another selected distance, as shown in FIG. 4, the pressure differential at main shaft seat 53 will have decreased sufficiently, such as to 30 psi, for regulator outer bellows 43 to begin contracting. That is, the internal bias force of regulator outer bellows 43 to contract will now be higher than the opposed force creating by the lubricant pressure. Preferably, main outer bellows 37 has still not contracted fully when regulator outer bellows 43 begins contracting.

Both main outer bellows 37 and regulator outer bellows 43 will be free to contract during a period of time while lubricant 47 is being routinely depleted due to leakage past main shaft seal 53. While both are free to contract, the total volume of lubricant subject to the contracting movement is greater than if only main outer bellows 37 is free to contract. Since the total volume is greater, for a given quantity of lubricant leakage, main outer bellows 37 will contract a lesser amount than if it were acting alone. For example, if over a selected period of time, 100 cc's (cubic centimeters) of lubricant leaked past main shaft seal 53, both main and regulator outer bellows 37, 43 would contract to make up and share that loss of 100 cc's. If acting alone, main outer bellows 37 would have to contract enough to make up all of the 100 cc's. Since main outer bellows 37 does not have to contract as much while being assisted by regulator outer bellows 43, the bias force of main bellows 37 to contract does not decrease as much. Since, the bias force does not decrease as much, the internal lubricant pressure decreases at a lesser rate over time than if main bellows 37 were acting alone.

Eventually, regulator outer bellows 43 will reach a fully contracted position while main outer bellows 37 is only partially contracted. Outer bellows 37 still has sufficient bias to maintain a positive pressure differential at main shaft seal 53, say of 25 psi. Outer bellows 37 will thus continue to contract while lubricant 47 is depleted, until reaching its fully contracted position. At this point, the pressure differential across main shaft seal 53 is zero.

Figure 6:
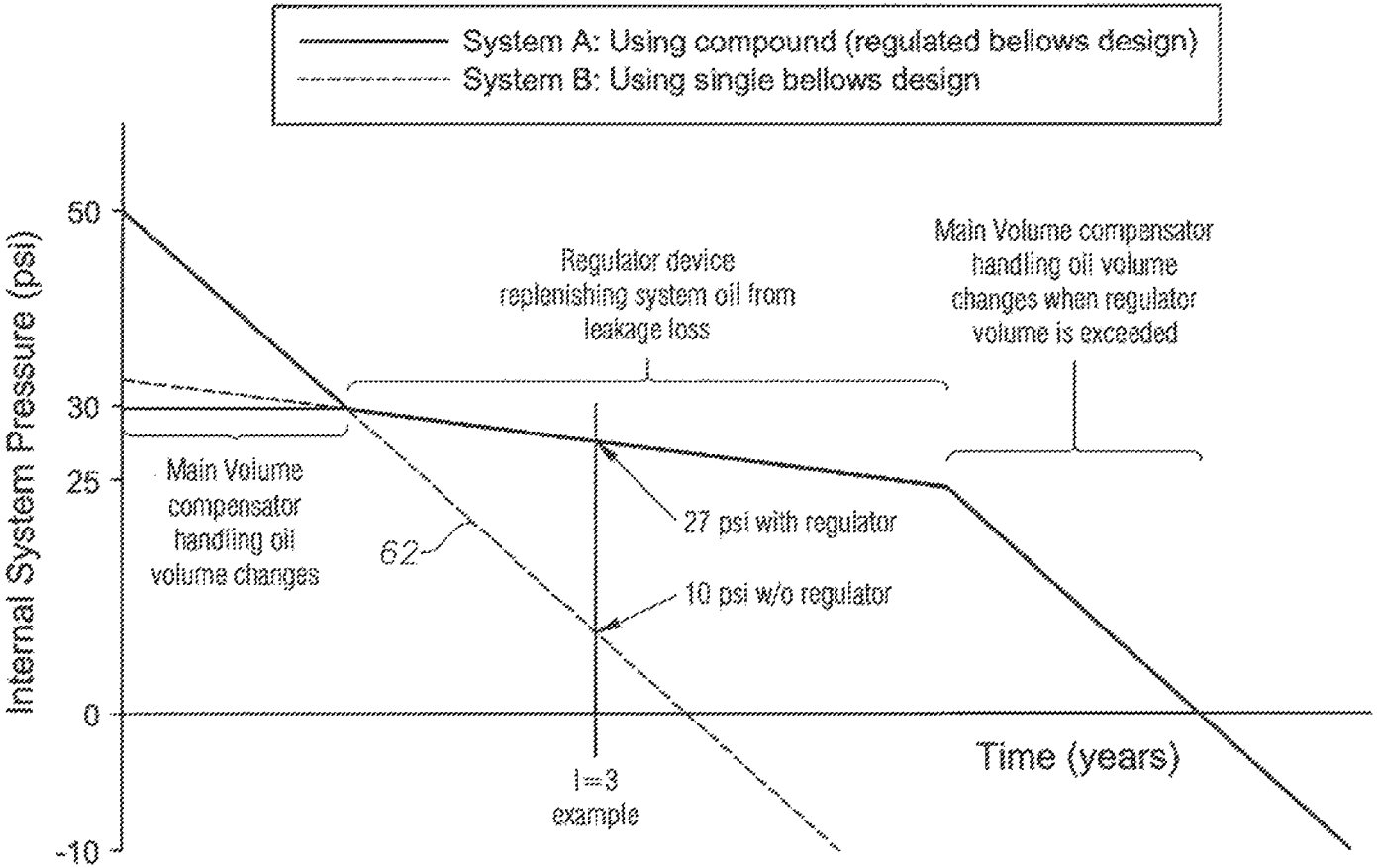
FIG. 6 is a graph illustrating internal lubricant pressure versus time of the system of FIG. 2 as compared to a prior art pressure compensator.

The graph of FIG. 6 illustrates the operational example just described. As the pressure differential decreases from 50 psi to 30 psi, only the main volume compensator or outer bellows 37 (FIG. 2) contracts due to lubricant depletion. From 30 psi to 25 psi, the regulator compensator or outer bellows 43 also contracts due to lubricant depletion. Below 25 psi, the regulator outer bellows 43 is folly contracted, and only the outer bellows 37 continues to contract.

The graph of FIG. 6 shows a line 62 schematically illustrating a prior art system ("System B") having only a single bellows type compensation system and also illustrating a line for System A, having both a main and regulator bellows. The System B single bellows is illustrated as also being initially charged to 50 psi and as contracting from 50 psi to sere along a linear line 62. The bellows of System B has the same spring rate and volume as the main bellows of System A, but not a volume equal to both the main bellows and regulatory bellows of System A. In System A, the regulator bellows fully extends during filling before the main bellows, say at 30 psi versus 50 psi. Consequently, only the main bellows is contracting or otherwise operating from 50 psi to 30 psi. The slope from 50 psi to 30 psi is illustrated to be the same for both Systems A and B because the spring rates are the same. The same amount of lubricant will be lost from 50 psi to 30 psi for both System A and System B.

The slope or rate of decline in internal lubricant pressure is much less during the period while both the main and regulator compensators (System A) are contracting, for example between 30 psi and 25 psi, than while only the single bellows System B operates. For each system, there is a higher leakage rate of lubricant past main shall seal 53 (FIG. 2) while the pressure differential is higher, say above 30 psi than in the range from 25 to 30 psi. System A decreases the rate of decline of pressure between 30 psi and 25 psi because both the main and regulator bellows are operating. The result is a considerably longer amount of time of a pressure differential in a desired 25 to 30 psi range than System B.

The graph of FIG. 6 gives an example of a time t+3 having a pressure differential of 27 psi existing while both main and regulator compensators 35, 41 are operating in System A versus 10 psi in prior art System B with only a single bellows. The optimal mid life portion of the ESP, for example from 25 to 30 psi pressure differential, is much longer for System A than System B because the rate of pressure differential decline is much less.

The graph of FIG. 6 shows that the regulatory bellows of System A fully contracts, for example at 25 psi, before the main bellows, which is at zero. The slope of System A from 25 psi to zero is illustrated to be the same as the slope from 50 psi to 30 psi, because only the main bellows will be operating in these ranges.

Figure 7:
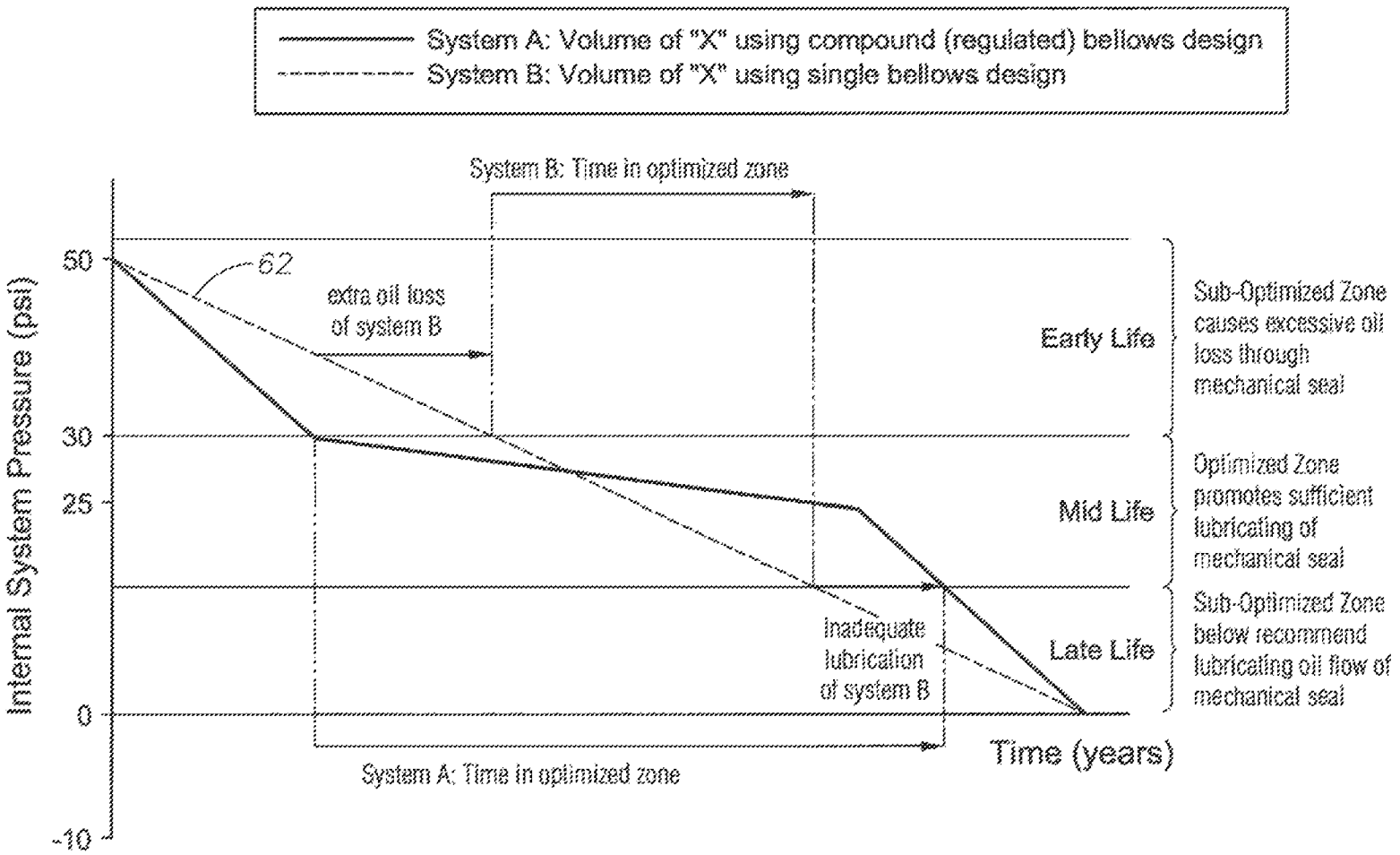
FIG. 7 is another graph of internal lubricant pressure versus time of the system of FIG. 2 as compared to a prior art pressure compensator.

FIG. 7 shows a similar graph to FIG. 6, but both Systems A and B having the same volume of lubricant initially while in FIG. 6. System A had a greater volume of lubricant initially. In the early life of the ESP, dotted line 62 shows there is excessive oil leakage across the main shaft seal 53, a sub-optimized zone, due to the higher than desired pressure differential across main shaft seal 53 (FIG. 2). In FIG. 7, the prior art System B is changed to have an equivalent maximum lubricant volume to System A, both the main and regulatory bellows. If this is done, the lifetime of System A is increased. However, because the spring rate of System B is linear from full extension to full contraction, less time is spent in the optimized zone. In the early life of System B, more oil is lost because of the higher pressure differential. In the later life of System B, the linear slope of the single bellows results in inadequate lubricant leakage for the shaft seal.

System A in FIG. 7 has a pester slope from 50 to 30 psi than System B during this sub-optimized zone, but the amount of time spent in this sub-optimized zone is less for System A than System B. System A has a much longer duration in the optimized zone from 30 psi to 25 psi than System B. System A has a steeper slope during the sub-optimized zone from 25 psi to zero than System. As but System A will maintain adequate lubrication for a longer time.

FIG. 5 shows an alternate embodiment, with only the main compensator homing 65 above motor 63. As in the first embodiment, main compensator housing 65 houses a main compensator 67 that includes a main outer bellows 69 and a main inner bellows 71. An upper connector 73 connects main compensator housing 65 to intake 23 of pump 19 (FIG. 1). A shaft seal 75 seals around a shaft 77 at upper connector 73. Upper connector 73 has a wed fluid entry passage 79 and optionally a passage containing an excess lubricant volume check valve 81.

In this embodiment regulator housing 83 secures below motor 63 to a motor connector 84. Regulator housing 83 contains a regulator compensator 85 made up of a regulator outer bellows 87 and regulator inner bellows 89. Regulator housing 83 has a lower end 91 that may have a well fluid entry port 93 and optionally a check valve 95 to expel excess lubricant. The embodiment of FIG. 5 works in the same manner as the first embodiment. The positions of main compensator 67 and regulator compensator 85 could be reversed.

While the disclosure has been described in only a few of its forms, it should be apparent to those skilled in the art that various changes may be made. For example, a spring could be used with one or more of the bellows. If the ESP is installed vertically, a weight could also be Used with one or more of the bellows. Further, rather than a regulator bellows, a piston with a spring or a weight urging it toward a lesser volume position within a piston cylinder. Also, rather than directly contacting one side of each bellows with well fluid, one or more of the bellows could be located within a secondary chamber containing n fluid other than well fluid. The well fluid could be in contact with the exterior of the secondary chamber, which equalizes the pressure of the secondary chamber fluid to the hydrostatic pressure.

The invention claimed is:

1. An electrical submersible pump assembly, comprising:

a pump;

a motor operatively coupled to the pump;

first and second compensating elements, each having one side adapted to be in fluid communication with hydrostatic fluid pressure and another side in fluid communication with motor lubricant pressure of motor lubricant contained in a lubricant chamber, the first and second compensating elements being movable in response to a pressure differential between hydrostatic well fluid pressure and motor lubricant pressure;

each of the first and second compensating elements having a bias that urges each of the first and second compensating elements to move from a full volume position toward a depleted volume position;

the bias of the first compensating element being greater than the bias of the second compensating element;

the bias of the first compensating element causing the first compensating element to be movable in response to the pressure differential being above a predetermined level and also below the predetermined level; and the bias of the second compensating element causing the second compensating element to be movable only in response to the pressure differential being below the predetermined level.

2. The assembly according to claim 1, wherein:

each of the first and second compensating elements comprises a bellows; and the bellows of the second compensating element has a lesser stiffness than the bellows of the first compensating element.

3. The assembly according to claim 1, wherein:

the first compensating element comprises a first bellows;

the second compensating element comprises a second bellows;

each of the first and second bellows has an extended position, which is the full volume position, and a contracted position, which is the depleted volume position, the bias of each of the first and second bellows urging the first and second bellows toward the contracted position; and the first bellows requires a greater force to move the first bellows to the extended position than moving the second bellows to the extended position.

4. The assembly according to claim 1, wherein:

the first compensating element comprises a first bellows;

the second compensating element comprises a second bellows;

each of the first and second bellows has an extended position, which is the full volume position, and a contracted position, which is the depleted volume position, the bias of each of the first and second bellows urging the first and second bellows toward the contracted position;

the bias of the first bellows causes the first bellows to be between the contracted position and the extended position while at the predetermined level of the pressure differential; and the bias of the second bellows causes the second bellows to be at the extended position while at the predetermined level of the pressure differential.

5. The assembly according to claim 1, wherein:

the first compensating element comprises a first bellows;

the second compensating element comprises a second bellows;

each of the first and second bellows has an extended position, which is the full volume position, and a contracted position, which is the depleted volume position, the bias of each of the first and second bellows urging the first and second bellows toward the contracted position;

the bias of the first bellows causes the first bellows to be at the extended position at a level above the predetermined level of the pressure differential;

the bias of the second bellows causes the second bellows to be at the extended position at the predetermined level of the pressure differential;

the bias of the second bellows causes the second bellows to be at the contracted position while at a lower level of the pressure differential below the predetermined level; and the first bellows is configured to be between the contracted and the extended positions when the pressure differential is below the lower level.

6. The assembly according to claim 1, wherein:

a housing containing the first and the second compensating elements;

first, second and third bulkheads axially spaced apart and fixed in the housing;

the first compensating element extends from the first to the second bulkhead;

the second compensating element extending from the second to the third bulkhead; and a lubricant passage in the second bulkhead communicates lubricant in an interior of the first compensating element directly with lubricant in an interior of the second compensating element.

7. The assembly according to claim 1, wherein:

each of the first and second compensating elements comprises a bellows with an interior containing the motor lubricant and an exterior adapted to be immersed in the well fluid;

the bellows of the first compensating element having a spring rate that causes the bellows of the first compensating element to contract in response to a change in the pressure differential while below the first predetermined level and also to contract in response to a change in the pressure differential while below a second predetermined level, which is lower than the first predetermined level;

the bellows of the second compensating element having a spring rate that causes the bellows of the second compensating element to contract in response to a change in the pressure differential while below the first predetermined level and above the second predetermined level; and the spring rate of the bellows of the second compensating element causing the bellows of the second compensating element to cease contracting in response to a change in the pressure differential below the second predetermined level.

8. The assembly according to claim 1, wherein:

each of the first and second compensating elements comprises a bellows; and the bellows of the first compensating element has a greater volume and greater spring rate than the bellows of the second compensating element.

9. The assembly according to claim 1, wherein:

one of the compensating elements is located above the motor and the other of the compensating elements is located below the motor.

10. An electrical submersible pump assembly, comprising:

a pump having a longitudinal axis;

a motor operatively coupled to the pump;

a pressure compensator having first and second bellows units axially separated from each other, each of the bellows units having an exterior in fluid communication with hydrostatic fluid pressure and an interior in fluid communication with motor lubricant pressure of motor lubricant contained in a lubricant chamber;

each of the first and second bellows units being movable between a full volume position and a depleted volume position, the first bellows unit having a spring rate that biases the first bellows unit toward the depleted volume position and the second bellows unit having a spring rate that biases the second bellows unit toward the depleted volume position; and the spring rate of the first bellows unit being greater than the spring rate of the second bellows unit;

the spring rates of the first and second bellows units being predetermined to cause the first bellows unit to move from the full volume position toward the depleted volume position while the second bellows unit remains in the full volume position during a first lubricant pressure differential range;

the spring rates of the first and second bellows units being predetermined to cause both the first and the second bellows to move toward the depleted position during a second lubricant pressure differential range that is lower than the first lubricant pressure range;

the spring rates of the first and second bellows units being predetermined to cause the second bellows unit to reach the depleted position when reaching a lower level of the second lubricant pressure differential range; and the spring rate of the first bellows unit being predetermined to cause the first bellows unit to continue moving toward the depleted position in a third lubricant pressure differential range that is below the second lubricant pressure differential range.

11. The assembly according to claim 10, wherein:

the first bellows unit has a greater volume capacity than the second bellows unit.

12. The assembly according to claim 10, further comprising:

a housing containing the first and the second bellows units;

first, second and third bulkheads axially spaced apart in the housing;

the first bellows unit extending from the first to the second bulkhead;

the second bellows unit extending from the second to the third bulkhead; and a lubricant passage in the second bulkhead that communicates lubricant in the interior of the first bellows unit directly with lubricant in the interior of the second bellows unit.

13. The assembly according to claim 10, wherein:

one of the bellows units is located above the motor and the other of the bellows units is located below the motor.

14. The assembly according to claim 10, wherein:

each of the bellows units comprises an outer bellows and an inner bellows joined to and extending axially from the outer bellows.

15. A method of pumping well fluid from a well, comprising the following steps:

(a) providing a pump, a motor, and connecting a compensator to the motor, the compensator having first and second compensator elements, each of the first and second compensating elements being biased from a full volume position toward a depleted position, the bias of the first compensating element being greater than the second compensating element;

(b) filling the motor with lubricant and communicating pressure of the motor lubricant to one side of each of the first and second compensating elements until each of the first and second compensating elements are in the full volume position;

(c) lowering the pump, motor and compensator into the well and applying hydrostatic fluid pressure of the well fluid to another side of each of the first and second compensating elements, which causes a positive pressure differential of the lubricant pressure over the hydrostatic fluid pressure;

(d) operating the pump with the motor and moving the first compensating element toward the depleted position in response to a drop in the differential pressure until reaching a predetermined first pressure differential level while the second compensating element remains non operational and in the full volume position; then (e) moving the second compensating element and the first compensating element toward the depleted positions while the differential pressure drops below the first pressure differential level.

16. The method according to claim 15, further comprising:

continuing step (e) until the differential pressure drops to a second pressure differential level, then ceasing movement of the second compensating element toward the depleted position; and continuing to move the first compensating element toward the depleted position as the differential pressure drops below the second lower pressure level.

* * * * *